US005392573A

United States Patent [19]

Gould

[11] Patent Number: 5,392,573

[45] Date of Patent: Feb. 28, 1995

[54] CONCRETE ANCHORING BOLT

[76] Inventor: William W. Gould, 2250 Oakhill Dr., Deland, Fla. 32720

[21] Appl. No.: 209,907

[22] Filed: Mar. 14, 1994

[51] Int. Cl.[6] ..... E04B 1/38; E04C 5/12

[52] U.S. Cl. ..... 52/165; 52/295; 52/704; 52/698; 411/386

[58] Field of Search ..... 52/698, 704, 706, 707, 52/708, 155, 165, 293.3, 295, 745.21

[56] References Cited

U.S. PATENT DOCUMENTS

| | | | |
|---|---|---|---|
| 581,353 | 4/1897 | Lamb | 52/698 X |
| 913,875 | 3/1909 | Cleverdon et al. | 52/704 X |
| 991,517 | 5/1911 | Kennedy | 52/704 X |
| 1,599,745 | 9/1926 | Cinnamond | 52/704 X |
| 1,629,880 | 5/1927 | Mirzan | 52/704 |
| 1,788,481 | 1/1931 | Brostrom | 52/707 X |
| 1,965,639 | 7/1934 | Glass | 52/704 X |
| 2,347,581 | 4/1944 | Turner | 52/698 X |
| 5,147,166 | 9/1992 | Harker | 411/29 |

*Primary Examiner*—Michael Safavi
*Assistant Examiner*—Robert J. Canfield
*Attorney, Agent, or Firm*—William M. Hobby, III

[57] ABSTRACT

A concrete anchoring bolt apparatus for anchoring a plate member or the like to a concrete surface includes a stake member having a nut-supporting open end having a nut secured therein. A threaded bolt member is threadedly attached to the nut secured in the stake member and has a concrete and bedding sleeve over the threaded bolt member. Washers are placed on both sides of the embedded sleeve and an anchoring nut is attached to the threaded bolt member over the embedding sleeve. The stake member has a pointed end so that positioning the stake member in the soil before a concrete pour and pouring the concrete thereover anchors the stake and sleeve in the concrete so that the threaded bolt member can be adjusted through the embedding sleeve into the stake member and an anchoring nut and washer can attach a plate member or the like to the surface of the concrete.

6 Claims, 1 Drawing Sheet

CONCRETE ANCHORING BOLT

BACKGROUND OF THE INVENTION

The present invention relates to anchoring bolts embedded in concrete for anchoring a plate or the like to a concrete surface.

Anchoring bolts have been widely used in the construction field for securing plates or to support structures to a concrete surface. In the past, anchoring bolts that have been embedded in concrete have generally been set at the time of the concrete pour or have been placed after the concrete has been poured and dried by drilling a bore and anchoring the bolt in the bore in the concrete. Correct placement of the anchoring bolts in relation to measured locations and for the correct depth into the concrete has proved costly. The obstruction created by prior anchoring bolts placed during the concrete pour has caused a problem by hampering the finishing operation when trying to produce a flat plane on the surface of the concrete in the area of the protruding anchor bolt. Placement of the anchor bolts is difficult when the bolt placement is required to be further into the slab area than can be reached from the exterior of the pour.

Different types of anchor bolt assemblies have been used in the construction field for securing a support structure or plate to a concrete surface and these include an anchor bolt assembly for inserting and attaching into a drilled bore in cured concrete. This has been commonly done by having an expandable portion of the bolt attached to a threaded stud or bolt which is placed in the bore formed in the concrete and applying a torque to the working part on the end of the bolt to cause rotation of the bolt and a radial widening of the expandable portion into engagement with the hard concrete surface on the inside of the bore. A second type of anchoring bolt assembly uses an adhesive or grouting material within the bore hole for securing the bolt in place when the resin or grouting material has sufficiently hardened. The working part on the outer end of the bolt is rotated to torque an anchoring section embedded in the grouting material.

Typical prior art bolt anchors for concrete can be seen in the U.S. Pat. No. 3,418,781 for a Bolt Anchor for Concrete which is adapted to be attached to a concrete form and to be embedded into the concrete after the concrete has set. This bolt anchor is a one-piece shell of thermal plastic material which has a bolt receiving socket therein so that the shell can be bolted to a concrete form before the concrete is poured. In the Worzala, Jr. U.S. Pat. No. 4,726,561, a Concrete Insert Apparatus is adapted to be embedded in concrete and has an internally threaded bore having a nail head end placed in the bore with the nail pointed end extending outwardly from the bore. The threaded bore is filled with wax to hold the nail in place so that the nail can be attached to a mold form for support during the pouring of the concrete and then the wax and nail removed once the concrete is cured. The Ogden U.S. Pat. No. 1,365,718, shows an Adjustable Concrete Insert with a threaded bore which attaches to a board for support during a concrete pour. The Sandin U.S. Pat. No. 3,333,388, is for a Concrete Block Anchoring Means for a Wall Plate or Cap and has a threaded bolt member threaded into a sleeve anchored in a bore in concrete within a concrete block. The Barton U.S. Pat. No. 1,145,462, is a Socket for Concrete Construction which has a spring-like member anchored in the concrete for threading a threaded screw member thereinto. The Kesselman U.S. Pat. No. 5,228,250, is for a Tamper Proof Anchor Bolt Assembly of the type inserted into a drilled bore in concrete with an expanding end portion for locking the expandable anchor into the bore. The Neptune U.S. Pat. No. 2,772,560, teaches a Pickup Device for Precast Concrete Slabs which anchors a bolt screwed into a nut in a poured concrete slab member for anchoring a bracket or the like. The Kowell U.S. Pat. No. 3,764,066, is for a Concrete Railroad Tie Product and includes a threaded insert member for placement in a mold for receiving poured concrete, which member has a threaded member that threads thereinto.

In contrast to some of the prior art anchoring bolts, the present anchoring bolt is directed towards providing an improved anchor bolt which is inexpensively manufactured and easily placed prior to pouring the concrete and which is easily adjusted for the correct embedment depth. The anchoring bolt allows for the preplacement of the anchor bolt to insure correct bolt placement so that placement of the bolt can be correctly measured for height and location prior to the pouring of the concrete and has an adjustable bolt passing through an embedded sleeve which can be adjusted to insure a secure tie-down for members being fastened to a concrete surface. After the concrete has dried, the threaded bolt may be threaded up to the desired height for attaching a plate to the surface of the concrete.

SUMMARY OF THE INVENTION

A concrete anchoring bolt apparatus for anchoring a plate member or the like to a concrete surface includes a stake member having a nut-supporting open end having a nut secured therein. A threaded bolt member is threadedly attached to the nut secured in the stake member and has a concrete embedding sleeve over the threaded bolt member. Washers are placed on both sides of the embedding sleeve and an anchoring nut is attached to the threaded bolt member over the embedding sleeve. The stake member has a pointed end so that positioning the stake member in the soil before a concrete pour and then pouring the concrete thereover anchors the stake and sleeve in the concrete so that the threaded bolt member can be adjusted through the embedding sleeve into the stake member and an anchoring nut and washer can attach a plate member or the like to the surface of the concrete.

BRIEF DESCRIPTION OF THE DRAWINGS

Other objects, features, and advantages of the present invention will be apparent from the written description and the drawings in which.

DESCRIPTION OF THE PREFERRED EMBODIMENT

Figure 1:
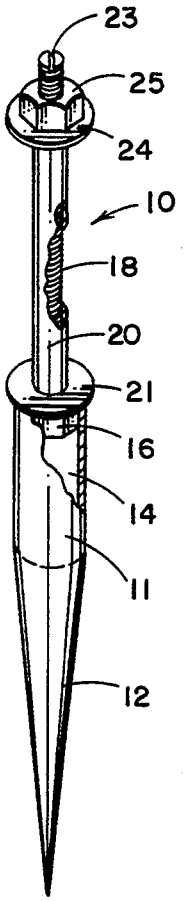
FIG. 1 is a perspective view of an anchor bolt in accordance with the present invention.
Figure 2:
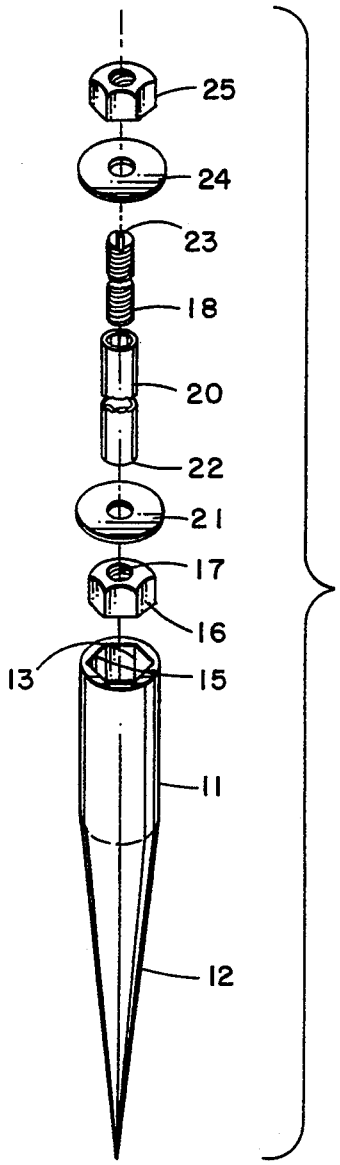
FIG. 2 is an exploded view of the anchor bolt of FIG. 1.

Referring to the drawings and especially to FIGS. 1 and 2, an anchoring bolt 10 has a stake 11 having a pointed end portion 12 and an open end portion 13 opening into a hollow interior portion 14. The opening 13 has shaped sides 15 for exactly receiving a predetermined nut 16 so that when a nut is inserted into the opening 13, it will be secured against rotation. The nut 16 has internal threads 17 and has the threaded bolt or elongated shaft 18 threaded into the threads 17 through a hollow sleeve 20. The embedding sleeve 20 has a washer 21 placed between the lower end 22 of the sleeve 20 and the top of the stake 11 adjacent the nut 16. The threaded bolt 18 has a slotted top 23 shaped for receiving a screwdriver tip for threading the bolt 18 into and out of the nut 16 which drives one end portion of the bolt 18 in and out of the hollow interior 14 of the stake 11. A top washer 24 is placed on the bolt 18 resting on the top of the sleeve 20 and a top nut 25 is bolted on top of the threaded bolt 18 down onto the washer 24.

Figure 3:
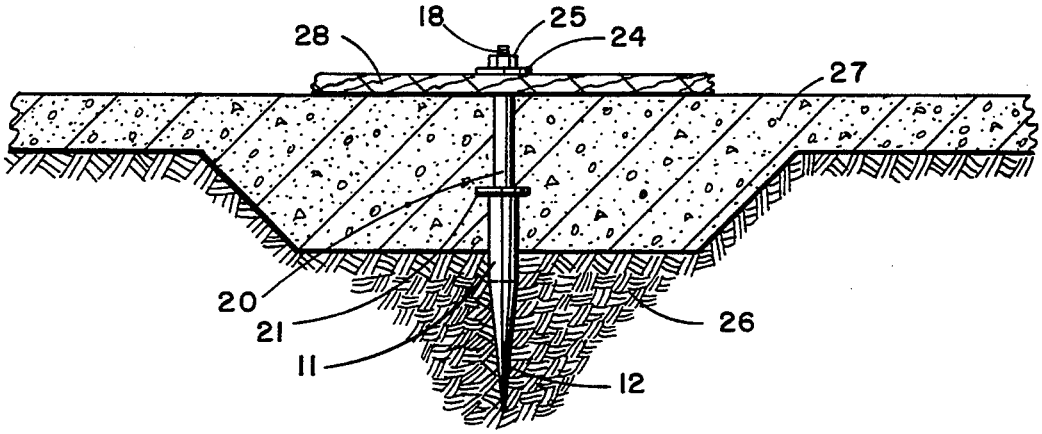
FIG. 3 is a sectional view taken through a poured concrete section having the present anchor bolt embedded therein and a plate attached thereto.

The assembled bolt, as shown in FIG. 3, can be inserted into the soil or subsoil 26 prior to the pouring of a concrete slab or the like. The subsoil 26 is typically a prepour grade and fill which has been shaped to receive the poured concrete slab 27. The pointed end 12 of the stake 11 has been inserted into the soil at the predetermined position and has the sleeve 20 attached thereto against the washer 21 and supported with the nut 25 threaded on the bolt 18 onto the washer 24. Once the concrete 27 has been poured and leveled, which can be accomplished with the bolt 18 threaded into the sleeve 20, if desired, and then threaded out to the desired height for attaching a plate or other member 28, as shown in FIG. 3. The plate which has a hole drilled therethrough it at the location where the bolt is placed over the protruding bolt 18 and the washer 24 placed thereover. Bolt 18 can then be adjusted with a screwdriver inserted into the slot 23 to a desired height to extend through the plate 28 a sufficient distance to attach the washer 24 and the nut 25. The anchor bolt assembly can be advantageously prepositioned prior to the pour in an exact location and can be adjusted for the height of the pour and, in addition, is rapidly adjusted for different size plates or members to be attached to the concrete surface.

It should be clear at this time that an anchor bolt assembly has been provided which alleviates some of the prior art problems with anchor bolt assemblies. However, it should also be clear that the present invention is not to be construed as limited to the forms shown which are to be considered illustrative rather than restrictive.

I claim:

1. An anchor bolt for anchoring a plate member or the like to a concrete surface comprising:
   - a nut;
   - a stake member having a nut supporting open end having said nut secured therein;
   - an embedding sleeve;
   - a threaded bolt member threadedly attached through said sleeve to said nut secured in said stake member; and
   - an anchoring nut and washer attached to said threaded bolt member over said embedding sleeve, whereby positioning said stake member in the soil before a concrete pour and pouring the concrete thereover anchors said stake member and sleeve in the concrete so that said anchoring nut and washer can attach a plate member or the like to the surface of the concrete.

2. An anchor bolt for anchoring a plate member or the like to a concrete surface in accordance with claim 1 including a second washer positioned on said threaded bolt member between said stake member and embedding sleeve.

3. An anchor bolt for anchoring a plate member or the like to a concrete surface in accordance with claim 2 in which said bolt member has slotted end for accepting a screwdriver for adjusting said bolt member in said nut in said stake member to adjust said bolt member position for a plate member.

4. An anchor bolt for anchoring a plate member or the like to a concrete surface in accordance with claim 3 in which said stake member has a pointed end portion.

5. An anchor bolt for anchoring a plate member or the like to a concrete surface in accordance with claim 4 in which said stake member has the open end shaped for a predetermined nut shape to fit thereinto to thereby hold said nut against rotation.

6. An anchor bolt for anchoring a plate member or the like to a concrete surface in accordance with claim 5 in which said nut is fixedly attached to said stake.

* * * * *